US005826455A

United States Patent [19]

Ohmori et al.

[11] Patent Number: 5,826,455

[45] Date of Patent: Oct. 27, 1998

[54] APPARATUS FOR REFORMING ROLLERS FOR SHAPING ROLLED STEEL

[75] Inventors: Kazuo Ohmori; Masayuki Okada; Toyohisa Tokumaru; Toru Takeuchi; Sumihiko Itoh, all of Okayama, Japan

[73] Assignee: Kawasaki Steel Corporation, Kobe, Japan

[21] Appl. No.: 719,541

[22] Filed: Sep. 25, 1996

[30] Foreign Application Priority Data

Sep. 29, 1995 [JP] Japan ..... 7-253665
Jan. 31, 1996 [JP] Japan ..... 8-015684

[51] Int. Cl.[6] ..... B21D 3/02; B21B 31/18

[52] U.S. Cl. ..... 72/164; 72/224; 72/247

[58] Field of Search ..... 72/164, 247, 224, 72/225; 492/1, 39

[56] References Cited

U.S. PATENT DOCUMENTS 5,060,498 10/1991 Seto et al. ..... 72/347
5,109,687 5/1992 Ooba et al. ..... 72/247
5,152,164 10/1992 Horiuchi ..... 72/247
5,154,074 10/1992 Haraguchi ..... 72/247

FOREIGN PATENT DOCUMENTS 0693329 1/1996 European Pat. Off. .

OTHER PUBLICATIONS

Patent Abstracts of Japan, vol. 17, No. 256 (M–1413), 20 May 1993 and JP–A–05 000328 (Sumitomo Metal Ind Ltd), 8 Jan. 1983.

*Primary Examiner*—Daniel C. Crane
*Attorney, Agent, or Firm*—Dvorak & Orum

[57] ABSTRACT

A mechanism for simply changing the roller width of a roller straightener for straightening the warp of rolled sections, having two or more straightening rolls and a mechanism for permitting at least one straightening roll to move in a direction parallel with a spindle using the rotational force of the spindle as a drive force.

2 Claims, 8 Drawing Sheets

APPARATUS FOR REFORMING ROLLERS FOR SHAPING ROLLED STEEL

BACKGROUND OF THE INVENTION

1. Field of the Invention

The present invention relates to a roller straightener having a straightening roller width changing device for straightening the warp of sections represented by wide flange beams.

As shown in FIG.7, a hot rolled and molded wide flange beam will have a temperature difference in a flange upper portion 51*a* as compared to a flange lower portion 51*b* and at right and left flanges due to the difference of cooling conditions at the upper and lower sides and the right and left sides of the beam. As a result, a difference in an amount of thermal contraction is created in the cooling process after the completion of rolling and deformation. A curve (FIG. 8(*a*)) and a warp (FIG. 8(*b*)) is formed in the wide flange beam when it is cooled down to room temperature. Further, deformation such as curve and warp is sometimes caused by the asymmetrical rolling in a right to left portion and an upper to lower portion due to a slight amount of difference in a roll peripheral speed and the like in a rolling process. Since a deformed wide flange beam has no commodity value, it must be straightened. In general, a wide flange beam is straightened by being passed through straightening rolls 5 disposed as shown in FIG. 9. As shown in FIG. 10, a roller straightener straightens the deformation of a wide flange beam in such a manner that bending deformation is repeatedly applied to the wide flange beam in the lengthwise direction thereof. The bending deformation action is gradually reduced while causing the inner surface of the flanges 51 of the wide flange beam to be abutted against the sides of the straightening rolls 5 or by providing a slight gap therebetween as well as rolling down a web 52 by the outer peripheral surfaces of the straightening rolls 5. Note, there is a roller straightener which is driven and not driven during straightening. For example, although a straightening roll is driven on the upper side of a wide flange beam in FIG. 8, a straightening roll is not generally driven on the lower side thereof.

2. Description of the Related Art

In a conventional roller straightener for wide flange beams (FIG. 3), the roller straightener includes a sleeve 3 having a pair of straightening rolls 5 being of a size corresponding to the size of the wide flange beam 1 and a spacer 45 set thereto and fitted to the outside of a spindle 2. A key 4 fixes the sleeve 3 to the spindle 2. Conventionally, when a straightening roller width, distance between straightening rolls, is changed to cope with the change of size of the wide flange beam 1, it is a general practice to entirely replace the sleeve to which a pair of the straightening rolls 5 and the spacer 45 are set. Thus, there is a problem that operation is delayed by a long time required to replace the straightening rolls. Furthermore, many straightening rolls corresponding to the sizes of wide flange beams must be prepared.

On the other hand, Japanese Patent Unexamined Publication No. 5-328 proposes a hydraulic operation type roller width change system for permitting the change of a straightening roller width online. However, the hydraulic operation system has so many problems in maintenance, that a hydraulic pressure must be supplied to a rotation spindle and it is difficult to perfectly seal the hydraulic pressure supply passage between the fixed portion and the rotating portion of the spindle, and the like. Further, the size of a pressurizing cylinder must be increased because the positions of the straightening rolls must be maintained against a thrust force applied from the piece being straightened.

In addition to the above Publication, although Japanese Patent Unexamined Publication No. 53-40674, Japanese Patent Unexamined Publication No. 2-284717 and U.S. Pat. No. 5,060,498 disclose technologies for changing a straightening roller width online, all of them require the addition of large equipment such as a drive unit for changing the roller width. Therefore, they do not satisfy the object of the present invention.

An object of the present invention is to provide a roller width changeable type roller straightener of a simple structure that is capable of solving the above problems and easily changing the straightening roller width of a roller straightener for straightening the warp of sections online by a remote operation.

SUMMARY OF THE INVENTION

The present invention developed to solve the above problems is a roller straightener having a mechanism for changing a straightening roller width using the rotational force of a spindle as a drive force. A first example of this structure has an open sided roller width changeable type roller straightener. A straightening roll among a pair of straightening rolls mounted to a sleeve attached to a spindle is fixed to the sleeve. The other straightening roll is made slidable with respect to the spindle. A straightening roller width can be changed online by a remote operation. Then, a nut ring meshed with the screw portion of a slidable straightening roll base is rotatably mounted to the sleeve. A nut ring fixing device is positioned on the spindle and a nut ring detent is in relation to a straightener main body. Both the straightening rolls and the nut ring are fixed to a spindle and rotate together with it during straightening. The nut ring is fixed by a detent so that it is not rotated while a straightening roller width is to be changed, and then the roller width is changed by the rotation of the spindle.

That is, a first structure of the present invention is an open sided roller straightener having a straightening roller width changing device for straightening the warp of wide flange beams arranged such that the straightening roll on one side of a pair of straightening rolls fitted onto the outside of the sleeve attached to a spindle, is fixed to a cylindrical base fitted to the sleeve, so as to be movable in contact with the outer periphery of the sleeve. Male threads are disposed in relation to the outer periphery of the base. A nut ring having female threads is meshed with the male threads. The nut ring is meshed with the screw portion of the cylindrical base, and a nut ring fixing pin is mounted on the spindle to which the sleeve is inserted and the detent of the nut ring is disposed to a straightener main body.

A second structure of the present invention is a double supported roller straightener having a straightening roller width changing device for straightening the warp of wide flange beams arranged such that one of a pair of straightening rolls fitted onto the outside of the sleeve attached to a spindle is fixed to a cylindrical base fitted to the sleeve so as to be movable in contact with the outer periphery of the sleeve. Male threads are disposed in relation to the outer peripheral portion of the base, and a nut ring having female threads is meshed with the male threads. The nut ring is rotatable with respect to the cylindrical base, and an internal gear is disposed to be commonly meshed with a nut ring detent external gear fixed to the sleeve and an external gear mounted to a nut ring holding portion. A detent release device is mounted to a straightener main body to permit the internal gear to be meshed with and released from the external gear.

Note, when rolled sections (steel sheet piles, channel steels etc.) other than wide flange beams are to be straightened, they can be straightened only by replacing the above sleeve with a sleeve to which straightening rolls corresponding to the material to be straightened, and some accessory members, are assembled. Thus the roller straightener of the present invention is applicable the straightening of almost all types of rolled sections.

DESCRIPTION OF THE PREFERRED EMBODIMENTS

According to the present invention, it suffices to provide a fixed straightening roll, a moving straightening roll, a nut ring, a nut ring fixing mechanism and a nut ring release mechanism with a sleeve and the structure of a straightener can be greatly simplified, when rolled sections (for example, steel sheet piles) other than wide flanged beams are to be straightened, the straightening rolls (sleeve) can be easily replaced. Further, since no special drive unit is needed to change a roller width, the apparatus can be simplified.

Embodiment-1

Figure 1:
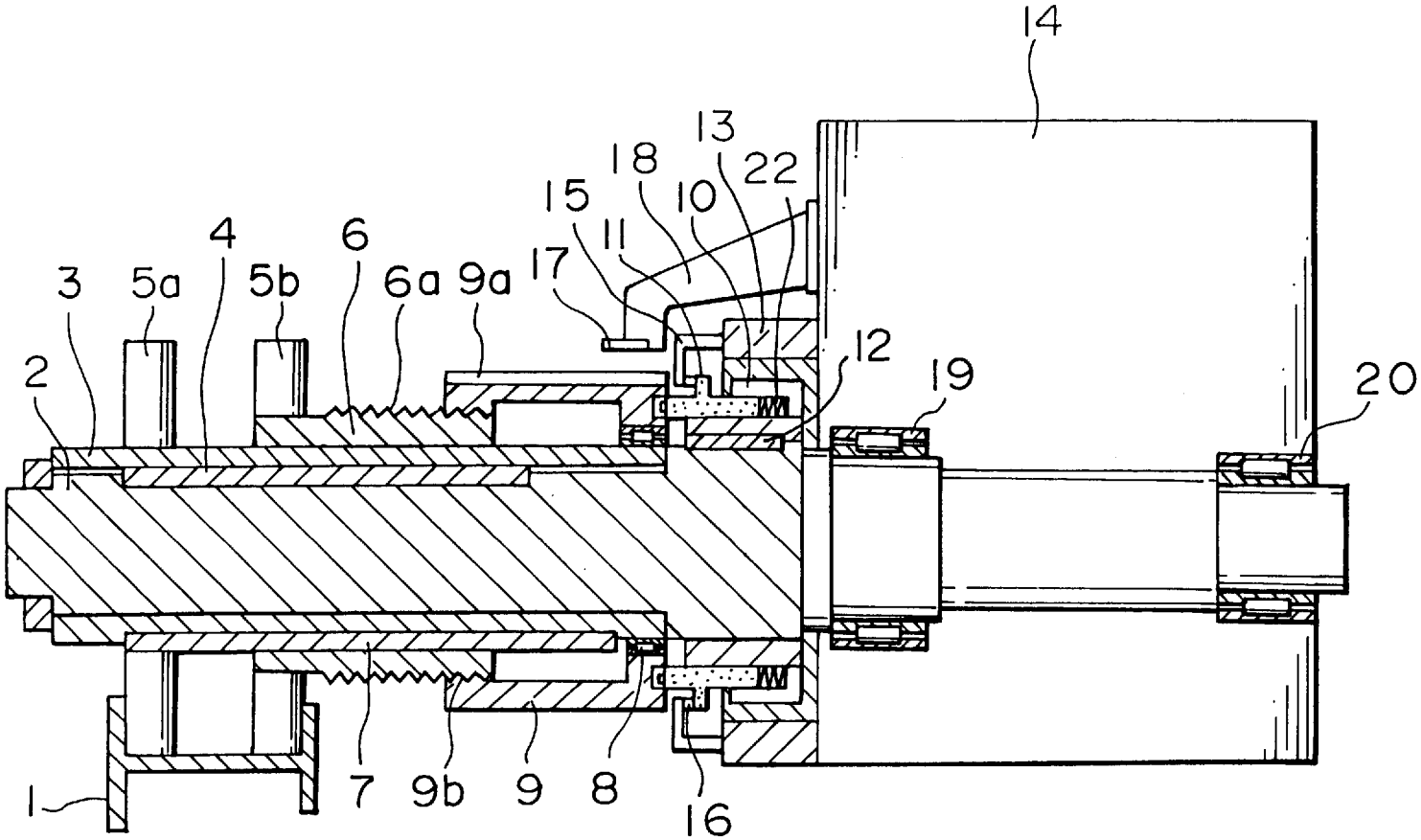
FIG. 1 is a cross sectional view of a straightening roller width changing apparatus of a roller straightener for sections of a first embodiment.

FIG. 1 is a cross sectional view showing the first embodiment of the present invention where a wide flanged beam 1 is being straightened by an open sided roller straightener.

Figure 2:
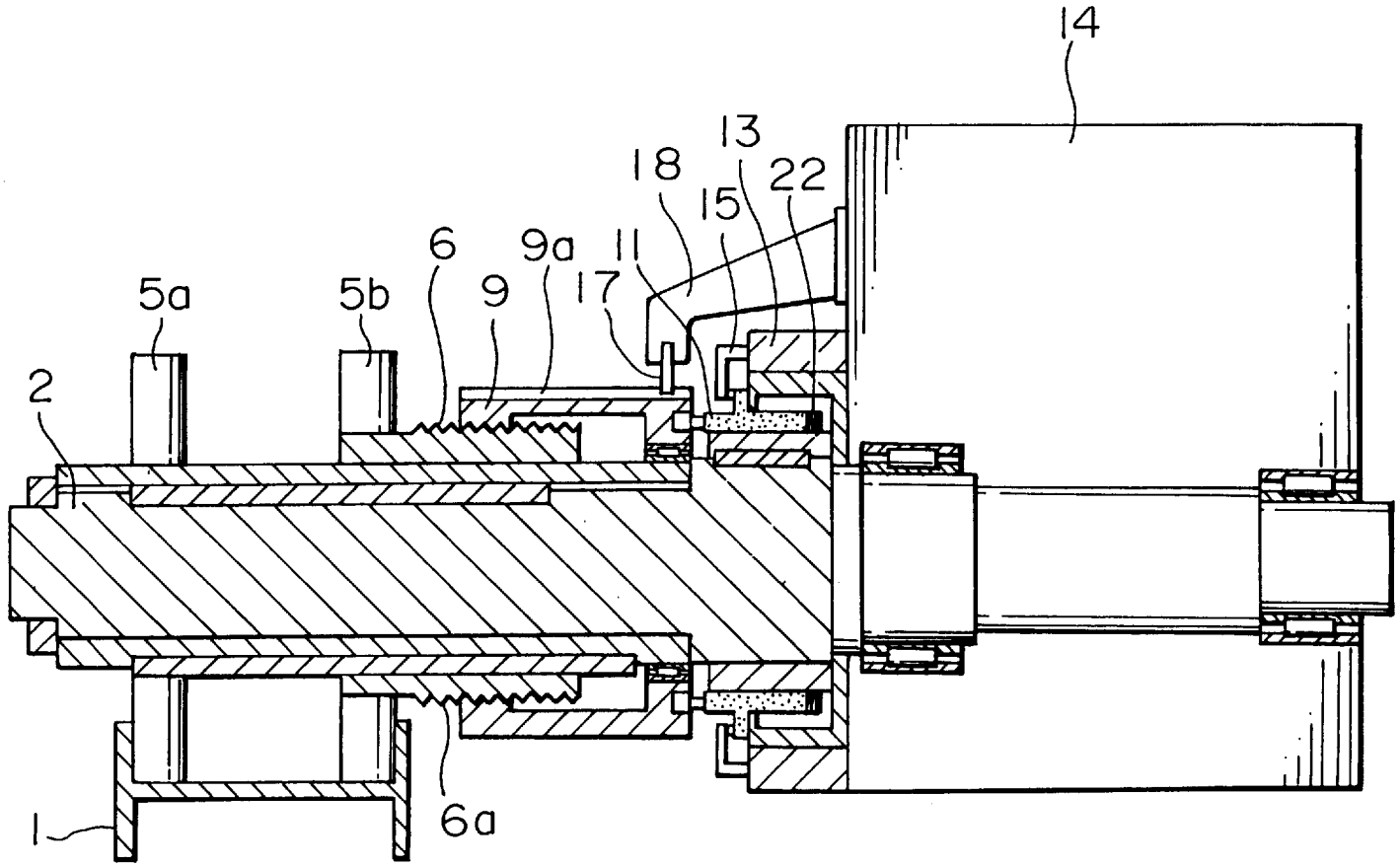
FIG. 2 is a cross sectional view of the straightening roller width changing apparatus of the roller straightener for sections of the first embodiment.
Figure 3:
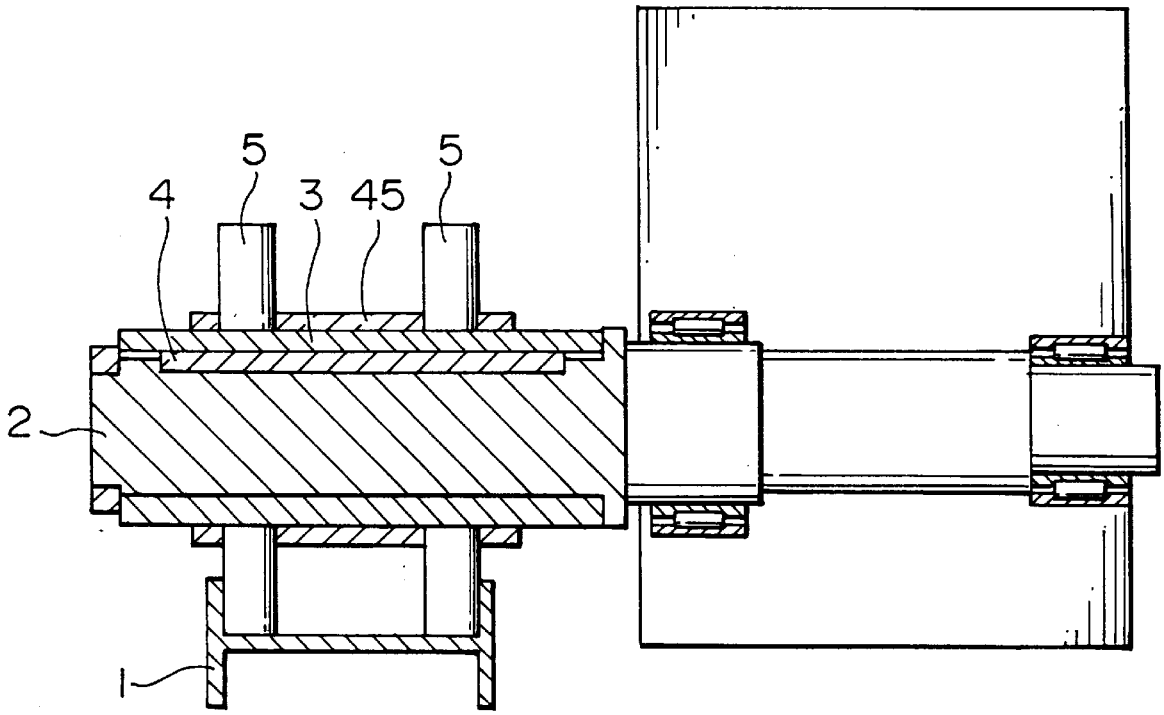
FIG. 3 PRIOR ART
FIG. 3 is a cross sectional view showing a conventional straightening roll.

A sleeve 3 is fitted onto the outer periphery of a spindle 2 and the rotational direction of the sleeve 3 is fixed to that of the spindle 2 by a key 4. A fixed straightening roll 5*a* and a moving straightening roll 5*b* are fitted to the outside of the sleeve 3 and the moving straightening roll 5*b* is fixed to a base 6 having a male screw 6*a*. A key 7 prevents the rotation of the fixed straightening roll 5*a* and the base 6 with respect to the sleeve 3. Further, a nut ring 9 is rotatably mounted to the sleeve 3 through a bearing 8. The female threads of the nut ring 9 engage the male screw 6*a* of the base 6. The holder 10 of a nut ring fixing pin 11 presses the fixing pin 11 against the nut ring 9 through a spring 22. A key 12 fixes the holder 10 to the spindle 2. A cylinder 13 is a cylindrical-shaped cylinder mounted to a main body 14 and an arm 15 is an arm for releasing the nut ring fixing pin 11 and has a roll 16 mounted at its extreme end. A nut ring detent 17 is rotatably mounted to a bracket 18 and is fitted into a groove 9*a* formed on the outer periphery of the nut ring 9 by being rotated 90° by a not shown cylinder or the like so as to be able to keep the nut ring 9 in an unrotational state as shown in FIG. 2. The spindle 2 is supported by bearings 19, 20. The bracket 18 is fixed to the main body frame 14.

FIG. 2 is a cross sectional view showing a roller width being changed, wherein the cylinder 13 is actuated to move the fixing pin 11 to the main body frame 14 by the arm 15 so that the nut ring 9 is in a rotatable state with respect to the spindle 2 and the sleeve 3. Further, the nut ring detent 17 is rotated 90° by a not shown cylinder or the like and is inserted into the groove 9*a* of the nut ring 9 to thereby prevent the rotation of the nut ring 9. The nut ring 9 is fixed to the main body frame 14 through the nut ring detent 17 and the bracket 18. The male threads 6*a* threaded to the female threads 9*b* are rotated by rotating the spindle 2 by a main drive motor or an auxiliary drive motor to thereby move the moving roll 5*b* in the longitudinal direction of the spindle. The amount of movement can be controlled by the screw pitch of the base 6 of the moving roll 5*b* and the amount of rotation of the spindle 2. The distance between the fixed roll 5*a* and the moving roll 5*b* can be arbitrarily changed. When a desired roller width is set, the nut ring detent 17 locked to the nut ring 9 is released and the nut ring fixing pin 11 is advanced to thereby integrally adjust the nut ring 9, the base 6 and the moving roll 5b with the spindle 2 to achieve the state shown in FIG. 1.

According to this embodiment, the roller width of the roller straightener for rolled sections can be very easily changed.

Embodiment-2

Figure 4:
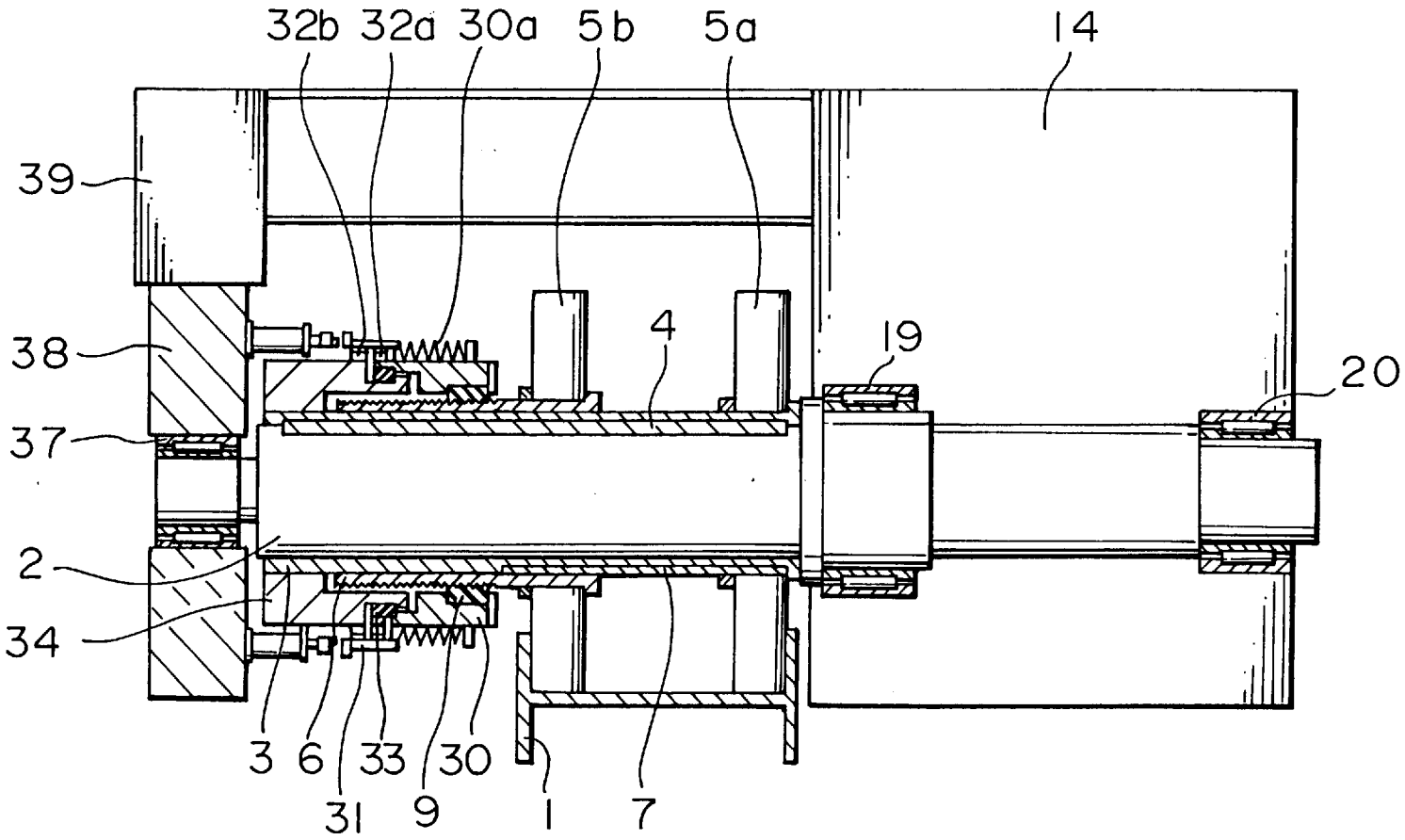
FIG. 4 is a cross sectional view showing the state in which straightening is carried out by a second embodiment of the present invention.

FIG. 4 is a cross sectional view showing a second embodiment of the present invention in which shown is the state where a wide flanged beam 1 is being straightened by a double supported roller straightener.

A sleeve 3 is fitted onto the outer periphery of a spindle 2 and the rotational direction of sleeve 3 is fixed to that of the spindle 2 by a key 4. A fixed straightening roll 5*a* and a moving straightening roll 5*b* are fitted to the outside of the sleeve 3 and the moving roll 5*b* is fixed to a cylindrical base 6. A key 7 prevents the rotation of the fixed roll 5*a* and the base 6 with respect to the sleeve 3.

A nut ring 9 engages a threaded portion on the outer periphery of the cylindrical base 6 and is fixed to a nut ring holder 30. A ring-shaped internal gear 31 pressed against the left by a spring 30*a* is slidably mounted to the outside surface of the nut ring holder 30 and an external gear 32*a* fixed to the nut ring holder 30 is meshed therewith. Further, a slide ring 33 is mounted to the inside surface of the nut ring holder 30 and rotatably held by a nut ring detent 34 fixed to the sleeve 3. An external gear 32*b* is mounted on the nut ring detent 34 and meshed with the internal gear 31 during straightening to thereby rotate the nut ring holder 30 together with the spindle 2 to prevent the change of a width. Drive side bearings 19, 20 are supported by a drive side frame 14. A non-drive side bearing 37 and a non-drive side chock 38 are supported by a non-drive side frame 39 and function to rise up and fall down by a not shown lift device when straightening rolls are replaced.

Figure 5:
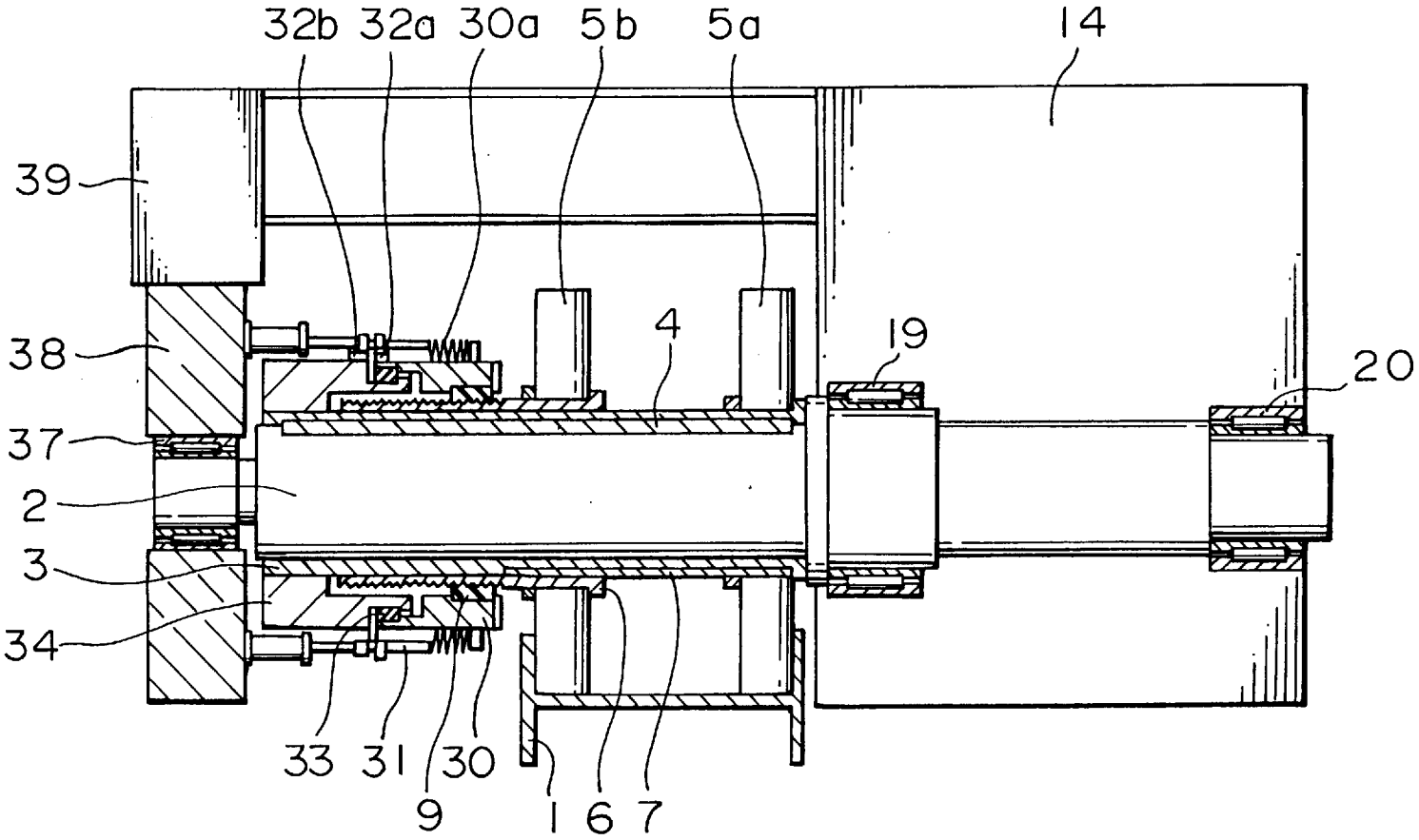
FIG. 5 is a cross sectional view showing an example in which a roller width is changed in the second embodiment of the present invention.
Figure 6:
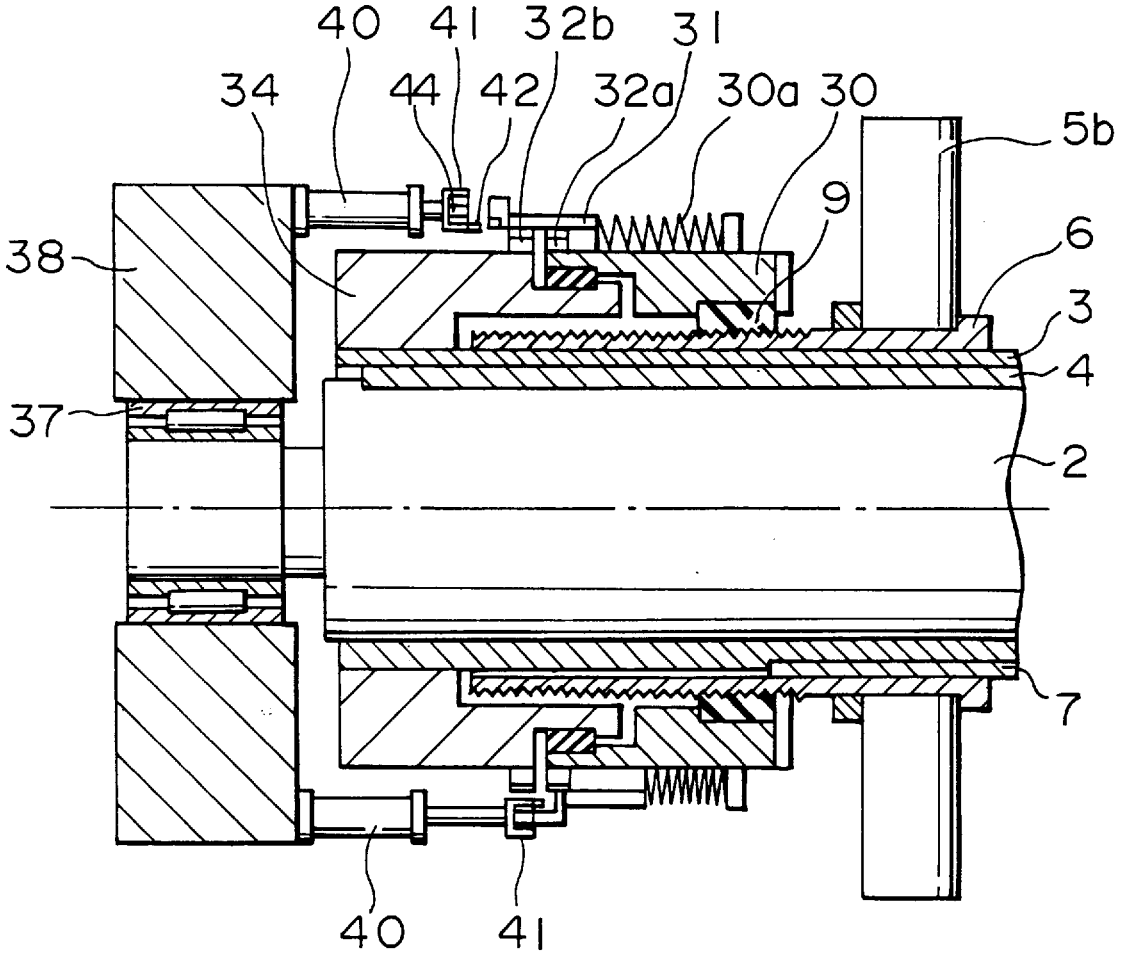
FIG. 6 is a cross sectional view of the second embodiment of the present invention (the upper half portion shows the state in which straightening is being carried out and the lower half portion shows the state wherein a roller width is being changed)
Figure 7:
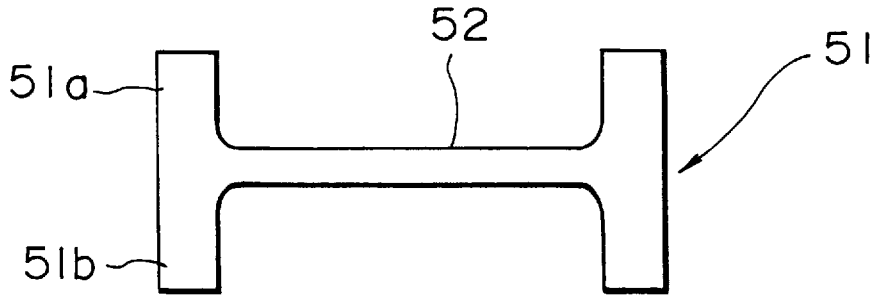
FIG. 7 is an end view of a wide flange beam.
Figure 8A:
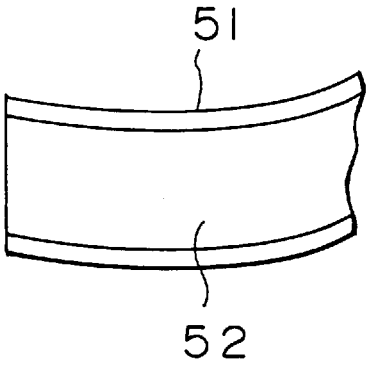
FIG. 8(*a*) shows curve and FIG. 8(*b*) shows warp of a beam.
Figure 8B:
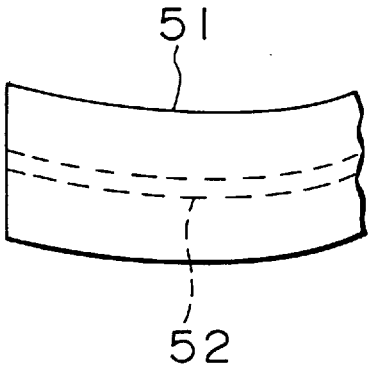
Figure 9:
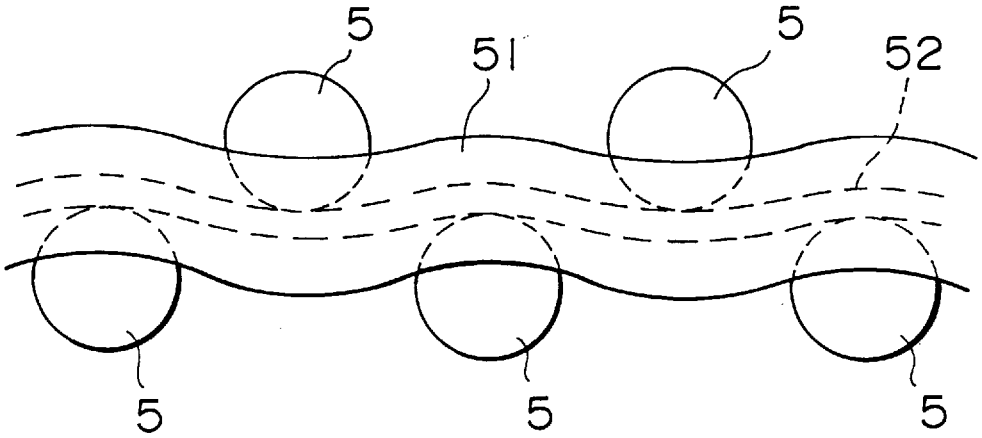
FIG. 9 is a view showing the disposition of a roller straightener in a straightening operation.
Figure 10:
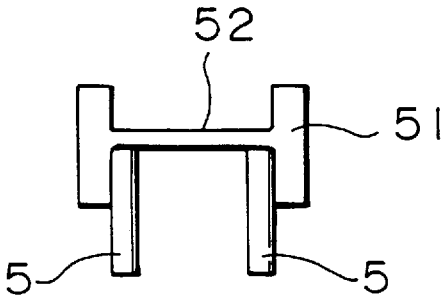
FIG. 10 is a view showing a straightening operation being carried out by the roller straightener of the present invention.

FIG. 5 is a cross sectional view showing the roller width of the straightener being changed. FIG. 6 is a cross sectional view showing the straightening being carried out on an upper half portion and a roller width being changed on a lower half portion. The external gear 32*b* engaged with the nut ring detent 34 and with the internal gear 31 is released therefrom by pressing a detent release device 41 against the internal gear 31 (refer to the lower half portion of FIG. 6) by actuating a cylinder 40 mounted to the non-drive side chock 38 (FIG. 6). A nut ring rotation restricting pin 42 is mounted at the extreme end of the detent release device 41 and the rotation of the nut ring 9 is stopped by the insertion of the pin 42 into the internal gear 31. The spindle 2 is rotated by a main drive motor-or an auxiliary drive motor in this case to move the cylindrical base 6 a predetermined amount. The cylindrical base can be controlled by screw pitch and the amount of rotation of the spindle.

A sensor 44 detects that the internal gear 31 is meshed with the external gear 32*a* and the nut ring is fixed to the sleeve.

According to this embodiment, the straightening roller width of the roller straightener for wide flange beams can be easily changed online.

Note, the present invention is not limited to the combination of the parts such as the gears and the like described in the above embodiments but may be any comparable mechanism so long as the it permits rolls to be horizontally moved by the rotation of a spindle.

Further, it is understood any type of the open sided roller straightener and double supported roller straightener may be employed.

In the roller straightener for wide flanged beams, since a straightening roller width can be adjusted online by a remote operation by the disposition of the nut mechanism to the sleeve to which the straightening rolls are set, a roll rearrangement can be eliminated, whereby productivity can be greatly improved. Further, since the mechanism is simplified, an amount of investment in plant and machinery can be greatly reduced. The present invention is also applicable to a straightener of a conventional system.

According to the present invention, the straightener can be adapted to simple mechanisms by mounting certain accessory members such as the fixed straightening roll, the sliding straightening roll, the nut ring and the like to the sleeve. Further, since it suffices only to mount the nut ring fixing device and the detent to the spindle and the main body, and since no special drive unit is needed to change the straightening roller width, the equipment is adapted simply as a unit and a conventional roller straightener can be remodeled by merely replacing certain accessory members such as the spindle, the sleeve and the like.

What is claimed is:

1. A roller straightener for straightening rolled steel sections, comprising:

a main body frame;

a rotating spindle having a pair of ends, one end journaled in said main body, said other spindle end extending in an axial direction away from said frame, said spindle rotatable about a rotation axis parallel to the axial direction;

a sleeve having an outside surface, said sleeve insertably fitted onto said spindle and fixed thereto;

a pair of straightening rolls arranged normal to said rotational axis and parallel to each other, one of said rolls a fixed straightening roll fixed to said sleeve on said end furthest from said frame, the other of said rolls an adjustably movable straightening roll disposed inwardly of said fixed roll, towards said frame, said movable roll attached to a threaded base which encircles said sleeve, said base rotatable about said sleeve and reversably movable in said axial direction;

a nut ring threadably connected to said threads of said base, said nut ring rotatable about said sleeve wherein rotation of said nut ring causes movement and axial adjustment of said movable straightening roll, said nut ring having an outer surface which includes a groove;

a nut ring fixing and releasing mechanism comprising a nut ring fixing pin and a detent, each said detent insertable in the groove of said nut ring engagable with said nut ring, for preventing rotation of said ring and axial movement of said movable roll during spindle operation, said detent mounted to said main body frame, said fixing pin adapted to engage said nut ring only when said movable roll is adjusted, wherein during axial adjustment said detent is disengaged from said nut ring, thereby allowing said nut ring to rotate in response to rotation of said spindle.

2. A roller straightener for straightening rolled steel sections, comprising:

a main body frame;

a rotating spindle having a pair of journaled ends, a first and drive side end journaled in said main body, a second and non-drive side spindle end extending in an axial direction away from said frame, said spindle rotatable about a rotation axis parallel to the axial direction;

a sleeve having an outside surface, said sleeve insertably fitted onto said spindle and fixed thereto;

a pair of straightening rolls arranged normal to said rotational axis and parallel to each other, one of said rolls a fixed straightening roll fixed to said sleeve on an end closest to said frame, the other of said rolls an adjustably movable straightening roll disposed outwardly of said fixed roll, away from said frame, said movable roll attached to a threaded base which encircles said sleeve, said base rotatable about said sleeve and reversably movable in said axial direction;

a nut ring threadably connected to said threads of said base, said nut ring rotatable about said sleeve wherein rotation of said nut ring causes movement and axial adjustment of said movable straightening roll;

a nut ring holder encircling said nut ring and attached thereto, said holder including a slidably mounted internal gear and a fixed external gear meshed with said internal gear;

a nut ring detent mounted to said sleeve, proximate to said second end of said spindle, said detent including an external gear meshed with said internal gear and a detent release device having a nut ring rotation restricting pin thereon, wherein when said pin is engaged with said internal gear, rotation of said nut ring is prevented and when said pin is disengaged, said nut ring is rotatable about said sleeve, said rotation causing movement and axial adjustment of said movable straightening roll.

* * * * *